US007850537B2

(12) United States Patent
Stern

(10) Patent No.: US 7,850,537 B2
(45) Date of Patent: Dec. 14, 2010

(54) VIBRATION-BASED TRAINING DEVICE AND METHOD

(76) Inventor: Ben D. Stern, 17008 E. El Pueblo Blvd., Fountain Hills, AZ (US) 85268

( * ) Notice: Subject to any disclaimer, the term of this patent is extended or adjusted under 35 U.S.C. 154(b) by 226 days.

(21) Appl. No.: 12/038,414

(22) Filed: Feb. 27, 2008

(65) Prior Publication Data

US 2009/0053682 A1 Feb. 26, 2009

Related U.S. Application Data

(60) Provisional application No. 60/957,040, filed on Aug. 21, 2007.

(51) Int. Cl.
*A63B 69/36* (2006.01)

(52) U.S. Cl. ..... 473/226; 473/219; 473/223

(58) Field of Classification Search ..... 473/207–226, 473/266, 457, 461, 464
See application file for complete search history.

(56) References Cited

U.S. PATENT DOCUMENTS

| | | | | | |
|---|---|---|---|---|---|
| 2,823,037 | A | | 2/1958 | La Ferte | |
| 4,090,711 | A | | 5/1978 | Amato | |
| 4,094,504 | A | * | 6/1978 | Barasch | 473/461 |
| 4,789,160 | A | * | 12/1988 | Dollar et al. | 473/223 |
| 4,930,785 | A | | 6/1990 | Mills | |
| 5,174,577 | A | | 12/1992 | Warde et al. | |
| 5,569,168 | A | * | 10/1996 | Hartwig | 601/133 |
| 5,681,993 | A | * | 10/1997 | Heitman | 73/379.02 |
| 5,911,635 | A | * | 6/1999 | Ogden | 473/224 |
| 5,984,799 | A | | 11/1999 | Romano | |
| 6,001,023 | A | * | 12/1999 | Sanchez et al. | 473/217 |
| 6,088,017 | A | | 7/2000 | Tremblay et al. | |
| 7,217,197 | B2 | | 5/2007 | Park | |
| 7,383,728 | B2 | * | 6/2008 | Noble et al. | 73/379.01 |
| 2004/0121849 | A1 | * | 6/2004 | Curkovic et al. | 473/277 |
| 2004/0214651 | A1 | * | 10/2004 | Park | 473/266 |
| 2004/0236386 | A1 | * | 11/2004 | Campos et al. | 607/48 |
| 2005/0046576 | A1 | * | 3/2005 | Julian et al. | 340/573.1 |
| 2005/0148431 | A1 | | 7/2005 | Laserow | |
| 2007/0004558 | A1 | | 1/2007 | Johansson | |
| 2008/0139331 | A1 | * | 6/2008 | Jang et al. | 473/215 |

FOREIGN PATENT DOCUMENTS

| | | | |
|---|---|---|---|
| DE | 20314616 | U1 | 1/2004 |
| KR | 2004092940 | A | 11/2004 |

* cited by examiner

*Primary Examiner*—Nini Legesse
(74) *Attorney, Agent, or Firm*—Matthew R. Schantz; Bingham McHale LLP

(57) ABSTRACT

Embodiments of a portable vibration device are disclosed, along with their use in enhancing performance for athletic and other processes requiring precise body control. A small portable housing is removably attachable to an athletic implement such as the shaft of a golf club. A battery-operated vibration mechanism within the housing operates at a frequency suitable for enhancing muscle performance through stimulation. A frequency control circuit operable by the user enables adjustment of the frequency for various circumstances. A removable pad attaches to the vibration mechanism and defines features adapted to match a particular intended implement, and a removable cam attached via an axle to a motor can be replaced by a cam adapted for use with that same type of implement.

21 Claims, 9 Drawing Sheets

VIBRATION-BASED TRAINING DEVICE AND METHOD

FIELD

The present invention relates to games using a tangible projectile. More specifically, the present invention relates to a device for developing or enhancing consistent motor movements, such as a club stroke for golfing or batting swing in baseball.

DESCRIPTION

Figure 1:
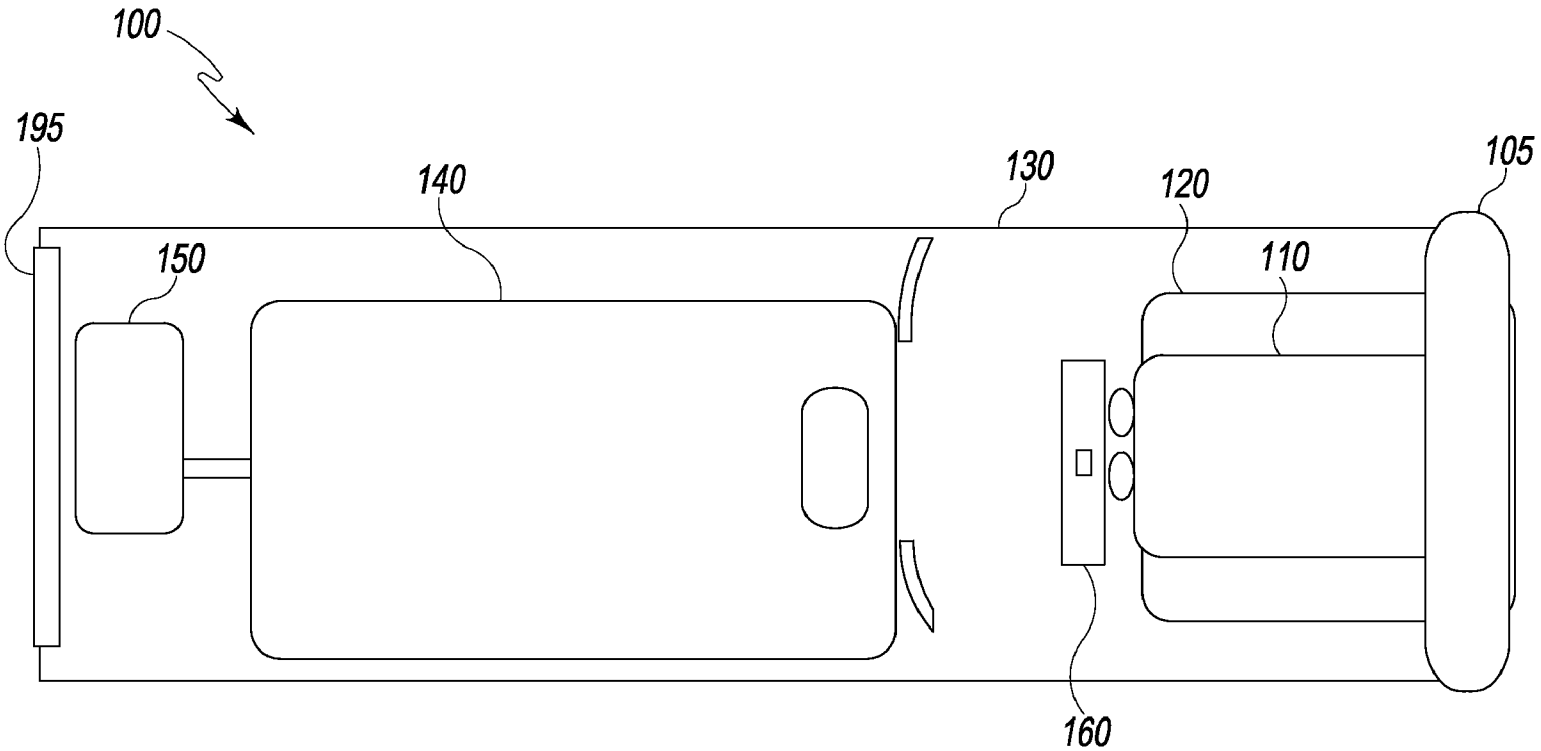
FIG. 1 is a schematic view of a training device in one embodiment.

For the purpose of promoting an understanding of the principles of the present invention, reference will now be made to the embodiment illustrated in the drawings and specific language will be used to describe the same. It will, nevertheless, be understood that no limitation of the scope of the invention is thereby intended; any alterations and further modifications of the described or illustrated embodiments, and any further applications of the principles of the invention as illustrated therein are contemplated as would normally occur to one skilled in the art to which the invention relates.

Figure 2:
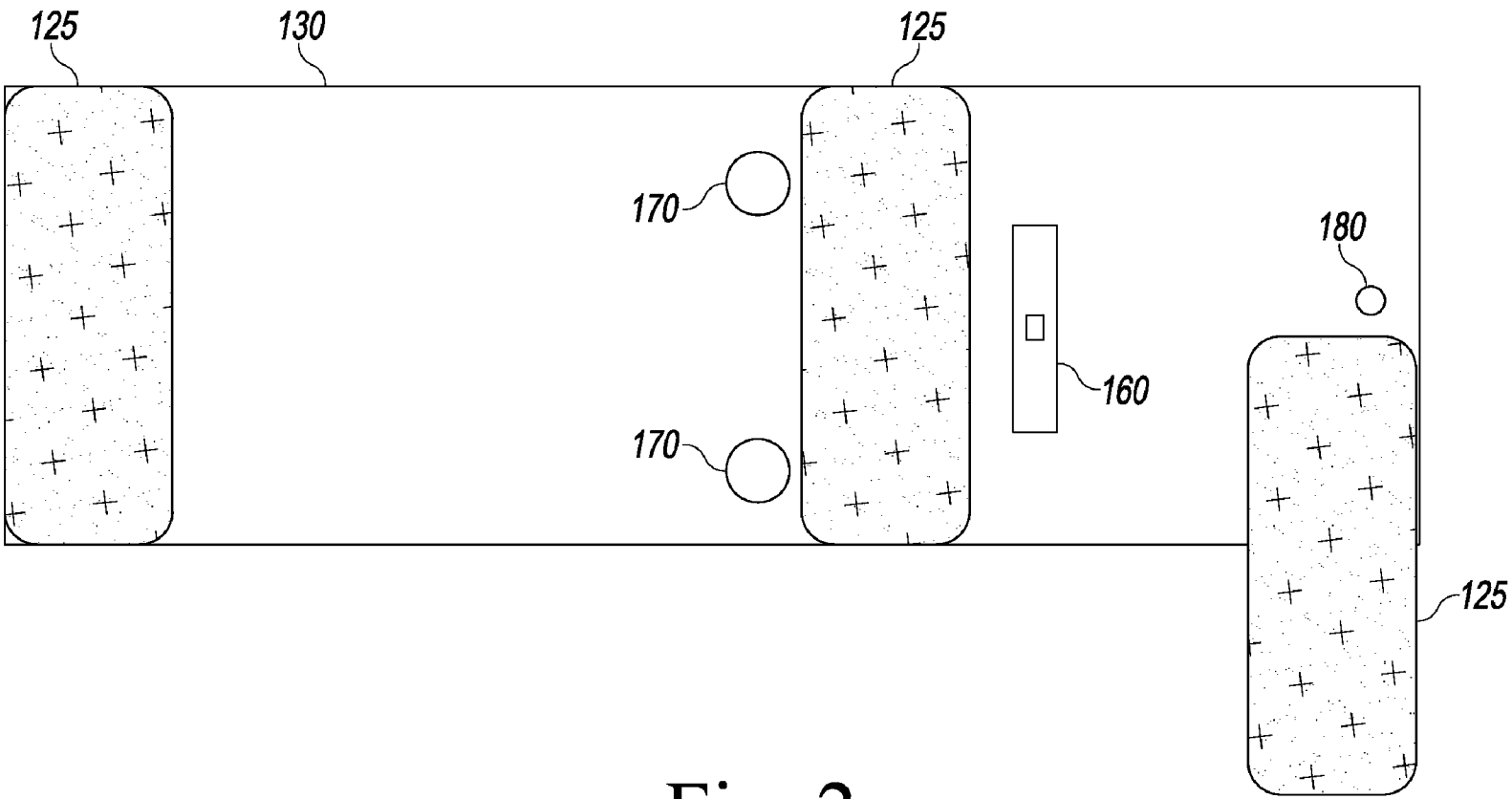
FIG. 2 is an external schematic view of the embodiment of FIG. 1.

One form of the present device is a training device that is removably attachable to the shaft of a swingable implement, such as a golf club or baseball bat, as illustrated in FIGS. 1-2. The device 100 includes a small, brushless motor 140 attached to a cam 150 that is approximately the height of the motor. Cam 150 is designed with its weight off-center so it produces vibration when it is rotated by motor. In one embodiment, shown in FIG. 1, the motor 140 is a Traxxas model 3975 Titan® 550 motor with a custom fabricated and welded eccentric cam 150. Power for this embodiment is provided by a 9-volt cell 110 placed within housing 120, though other attached or detached power systems are used in other embodiments.

Motor 140 is placed within the main portion of plastic tube 130 and wired in series with 9-volt cell 110 and switch 160. The battery housing 120 is secured to the main portion 130 of the housing screws through holes 180 or other attachment methods as will occur to those skilled in the art. Turning to FIG. 2, vent holes 170 through the plastic tube 130 allow ventilation for motor 140 and passive cooling of the device 100. Plastic cap 195 seals the end of plastic tube 130 opposite housing 120, while rubber gasket 105 seals the juncture between the housing components 120 and 130. Gasket 105 also extends radially beyond the diameter of plastic tubing 130 to provide additional friction and inhibit slippage when the device is attached to something. Fastener straps 125 are preferably made from a hook-and-loop material such as Velcro® and affixed permanently in at least one location to plastic tube 130 or battery housing 120.

When the device is in use, the fastener straps 125 are wrapped around something that a person holds or moves during an activity. For example, in one mode of use the device is attached to a golf club on or near the handle. The device is switched on and vibrates the golf club during a rest break, practice or exercise. The vibration induces improved muscle control and muscle memory and, therefore, accuracy by improving positioning and motion of the club during the user's swing.

Another application of the device is for batting practice. The device is strapped to a baseball bat using fastener straps 125, then is turned on using switch 160 during training and practice swings.

Yet another application of the device is for relaxation or to decrease discomfort. Vibration imparted by the device is perceived by the skin and joints. The device is attached directly to an implement held in the hands or applied to the muscles targeted for relaxation. For instance, a tennis player feeling tight or tense because of pain or nervousness attaches the device to the racquet handle. The player relaxes, holds the racquet lightly, and the device is turned on imparting a gentle massage to the hands. A runner uses the device in a similar fashion by attaching the device to her feet or legs. A soccer player preparing to take a penalty kick attaches the device to the surface of his soccer boot to help aid in relaxation, while a basketball player applies the device to her hands during a time out immediately prior to shooting free throws. A golfer suffering from discomfort secondary to arthritis in his hands applies the device to his golf club, turns it on and swings his club while waiting to tee off to relieve discomfort. A gymnast attaches the device to a pole or cane and turns the device on while performing a stretching program to enhance muscle and joint flexibility and mobility. This also applies to many other activities and settings.

Yet another application of the device is for acute/transient muscle stimulation. The user engages in a short bout (2-10 minutes) of training immediately prior to participating in activity. This preparation may enhance muscle fiber activity during and after submaximal isometric and dynamic contractions. The device may be attached to almost any sporting device to facilitate increased performance. For example, a baseball player who is "on deck" waiting for his turn to bat may attach the device to his bat. The batter then may perform static and/or dynamic movements with the bat while the device is turned on. A static movement may consist of simply holding the bat at impact position or at full backswing. A dynamic movement may be gently swinging the bat as the baseball player would normally swing when he is at the plate. When it is his turn to bat, the player removes the device from his bat. This mode of use could be applied to many sports (cricket, golf, etc.). In addition, a sprinter could apply the device (in its present form in a suitably modified case, such as an arm or leg wrap housing that might double as an ice pack housing) to his calves prior to sprinting, a discus thrower to the disc, a javelin thrower to the javelin, a golfer to the golf club, a rock climber to their ice pick or training board, etc. A golfer may attach the device (in some form or modified casing, such as a specialized housing belt) to his back, thus stimulating muscles involved in stabilization of the trunk or generation of speed via rotation utilizing the muscles of the back and trunk.

Still another use of this device is to help decrease the risk of certain sports injuries via stimulation of muscles. One use in this setting is to decrease the likelihood of suffering an ankle inversion sprain by stimulating the muscles on the outside of the lower leg (peroneus longus and brevis). For example, a football player who suffers from chronic inversion ankle sprains may have the device applied to the outside of his lower leg during rest periods. In addition to a physical stimulation of the muscles, this use may provide a reminder to the user to utilize proper form and thus avoid injury. Another use in this vein is to enhance stretching and/or warm-up exercise. For example, a pair of devices could be placed on the user's arms using arm bands while the user does push-ups or stretches. This application is believed to enhance joint and muscle flexibility.

Once a muscle group becomes fatigued (and thus theoretically more susceptible to injury), it may be possible to overcome this fatigue to some degree with application of a vibratory stimulus. If a tennis athlete, for example, suffering from sensations of forearm fatigue, is sitting on the side of the court during a change of sides in a tennis match, the athlete may be able to apply the vibration by holding the racquet and thus re-invigorate the fatigued forearm muscles. When rehabilitating from an injury, the device may be utilized in a sport-specific manner to regain strength and neuromuscular coordination. A tennis player recovering from tennis elbow or lateral epicondylalgia may perform upper extremity exercises using the tennis racquet with the device attached. A soccer player who is rehabilitating from an inversion sprain may train by attaching the device to his foot or lower leg and performing ankle exercises. The device might be used by individuals undergoing bed rest in a hospital. The individual might practice moving their limbs with the vibration device either attached to the limb or to an instrument held in the hand or foot. By performing these actions, the expected decline in muscle output may be diminished.

Usage of this device may also be incorporated into regularly scheduled training multiple times per week to enhance strength. A golfer may attach the device to the handle of her golf club, and after turning the device on, may practice bringing the club into the impact position and holding it there for 30 seconds followed by 30-second holds in the full backswing and follow-through positions. She may then decide to perform four repetitions of this pattern and conclude the vibration portion of her exercise session with two minutes of full swings with the device turned on. She may then continue with her usual exercise routine whether it includes weight training, cardiovascular conditioning, stretching, and the like. Likewise, a bicyclist may use vibrating pedals to improve performance in cycling and with stationary bikes or elliptical trainers. A waterproof version is suitable for swimmers in arm band form or for surfers, either as an ankle band or incorporated into surfboards, while another version works within a ski boot, within a snowboard, or with ski poles.

Use of this device may also be a pain-free way for individuals suffering from bone loss to exercise in a way that is low-impact and therefore less likely to cause injury due to bone fracture. These individuals may strap the device to a cane or other implement and practice various exercises with their extremities.

In another application, the device may induce positive adaptations in peripheral blood circulation. Use of the device by placement either directly on or attached to implements held by the hands or feet could result in increased activation of muscles of those extremities. This leads to increased perfusion of those muscles and, therefore, increased circulation to the extremities. Use in this manner may be of benefit for those suffering from peripheral circulatory derangement such as Type II diabetes mellitus.

Attaching the device to the shoe of an older individual and having that individual move their leg through some range of motion with the device turned on may enhance proprioception of the joints of the lower extremity through training of the muscle spindles and joint receptors. This increased awareness of body position in space or kinesthetic awareness may decrease risk of future falls.

An alternative design for the device includes a microcontroller programmed to generate a simple square wave, which is supplied as a DC voltage signal to the DC brushed motor at a software-determined frequency (i.e., a software controlled motor speed). A simple cam system is then connected to the shaft of the motor. The frequency of the vibration could then be controlled by the software or ultimately by a user of the device through a microcontroller-sampled user interface device such as an encoder, potentiometer, or buttons. The software could then be customized to accommodate the appropriate range of frequencies desired. Software algorithms to implement these applications will occur to those skilled in this area of technology.

Other implementations of this device include embedding the device (electro-mechanical system) or building the device into an athletic implement such as a golf club or baseball bat as opposed to strapping a separate chassis to an existing athletic implement.

Figure 3:
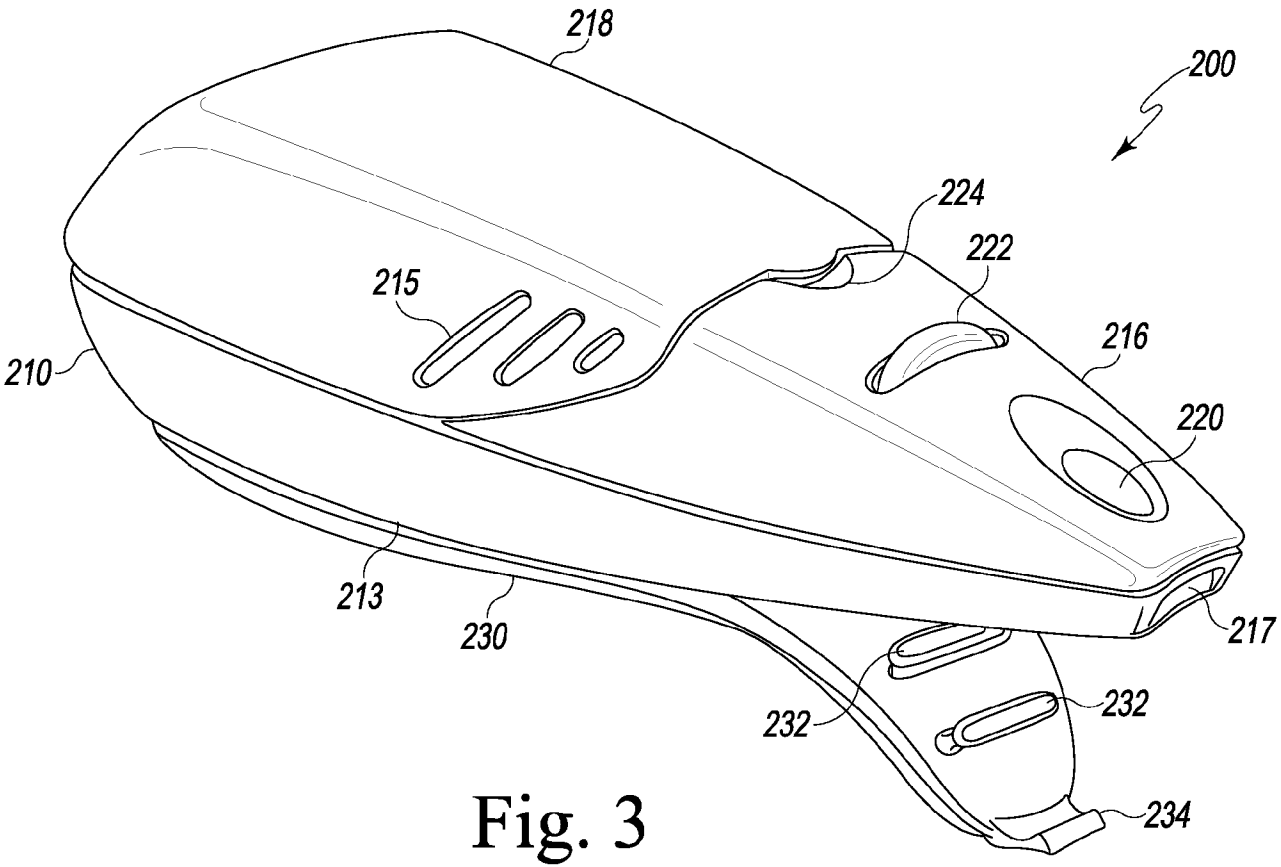
FIG. 3 is a perspective view of the external case of a second embodiment.

Another implementation is shown in FIG. 3 and allows the user to exchange cams (150 in FIG. 1) for cams of alternative shape, mass, and/or relative center of mass. This embodiment of device 200 includes enclosure 210 and has a main lower shell 213, a control shell 216, and a battery compartment cover 218. Motor ventilation holes 217 in battery compartment cover 218 enable airflow for cooling of the components internal to enclosure 210. Control shell 216 includes a depression and defines an opening for power button 220, defines an opening for frequency selector 222, and includes an indentation 224 next to the edge of battery compartment cover 218 to facilitate the removal by users of battery cover compartment 218.

On the opposite side of device 200 from control shell 216 and battery cover compartment 218 is pad 230, which is removably connected to lower shell 213 by pad anchors 232. Finger pull tab 234 rests in depression 215 in lower shell 213 when device 200 is in use, and facilitates removal of pad 230 from lower shell 213 for replacement by a replacement pad or a pad of a different configuration.

Figure 4:
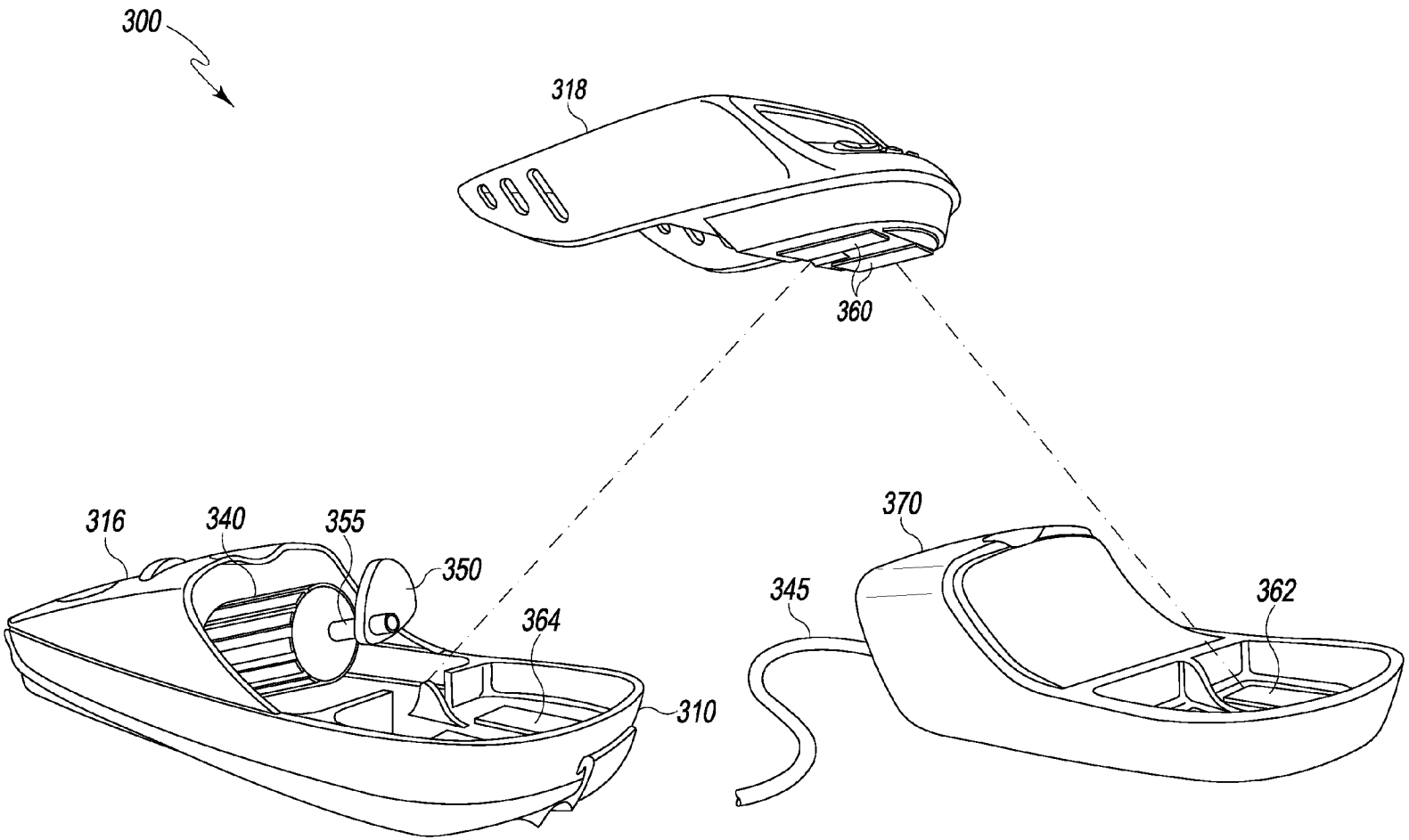
FIG. 4 is a perspective view of a charging dock used with the embodiment of FIG. 3.

FIG. 4 illustrates a docking station and battery component of a rechargeable variation 300 of the embodiment in FIG. 3. In this variation, battery pack 318 is removed from the remainder of the device and placed in contact with charging station 370 so that mating structures mate. In particular, electrical contacts 360 on battery pack 318 meet with electrical contacts 362 on charging station 370 so that power coming to charging station 370 through cord 345 can be passed into an energy storage device (such as a battery) in battery pack 318. In some embodiments, cord 345 connects to a wall outlet or DC converter, while in others cord 345 connects to a powered USB port or similar connection to a personal computer, while in still others another source of energy is used. Then, in preparation for use, battery pack 318 rests in lower shell 310 so that electrical contacts 360 of battery pack 318 meet with electrical contacts 364 inside lower shell 310.

Figure 5:
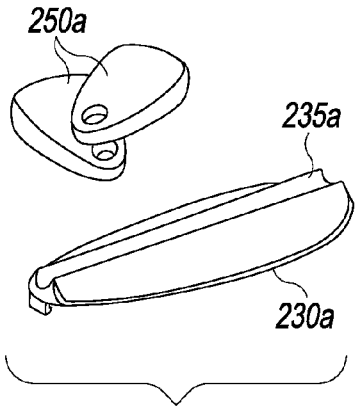
FIGS. 5-8 are perspective views of pad and cam kits for use with the embodiment of FIG. 3.
Figure 6:
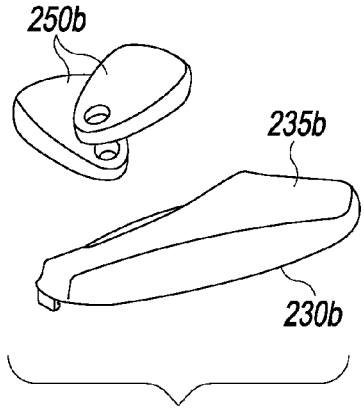
Figure 7:
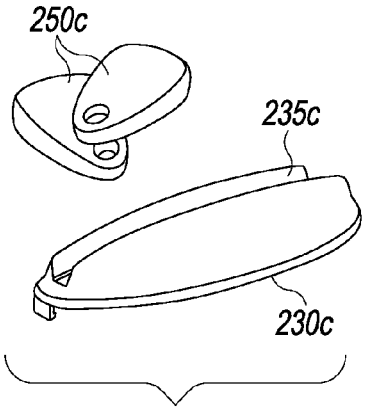
Figure 8:
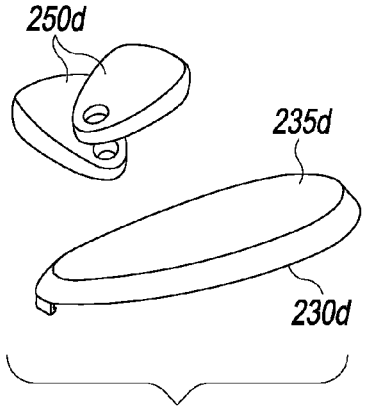
Figure 9B:
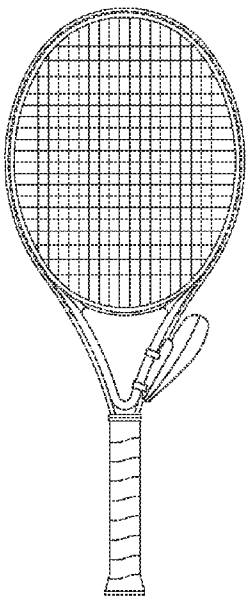
FIGS. 9A-9Q are a series of perspective views of various embodiments with various swingable items described herein.
Figure 9C:
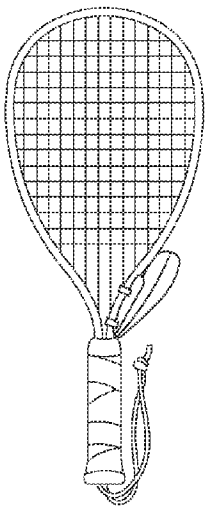
Figure 9D:
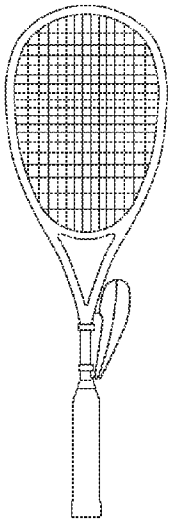
Figure 9E:
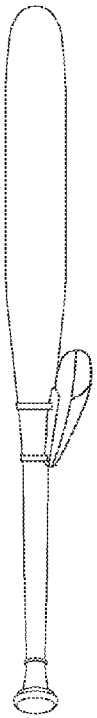
Figure 9A:
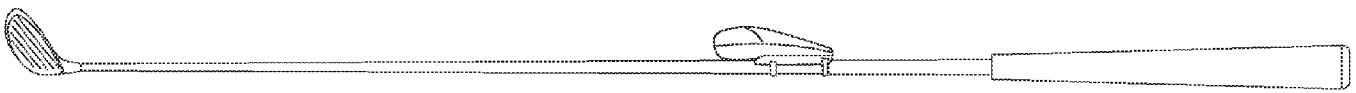
Figure 9F:
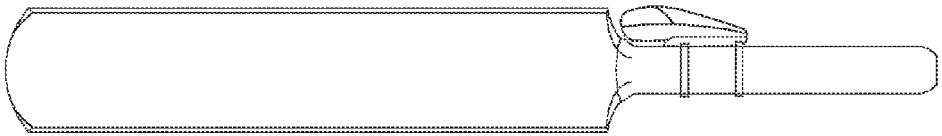
Figure 9G:
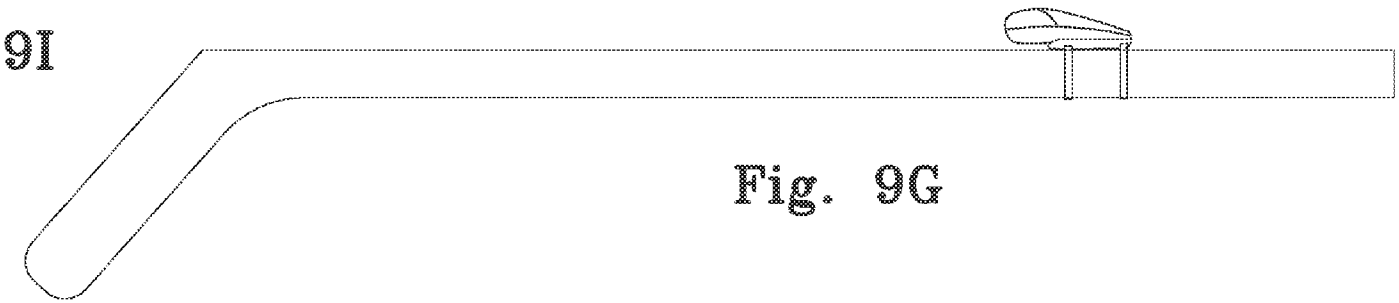
Figure 9H:
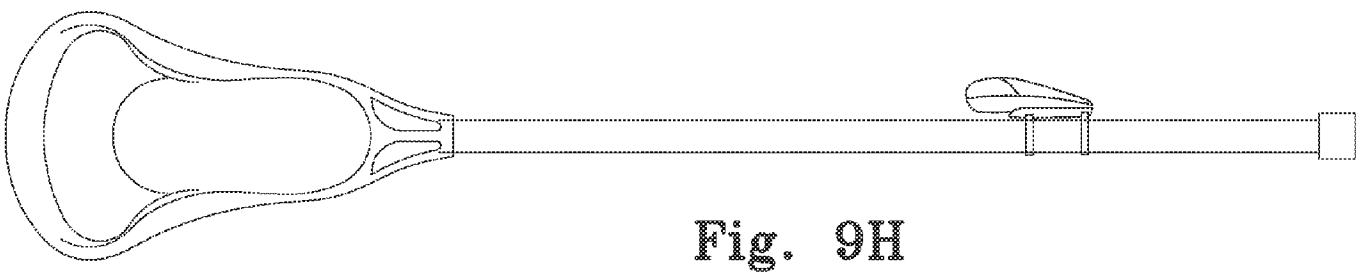
Figure 9I:
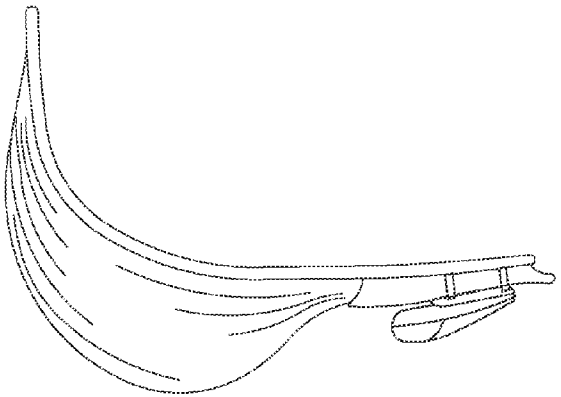
Figure 9J:
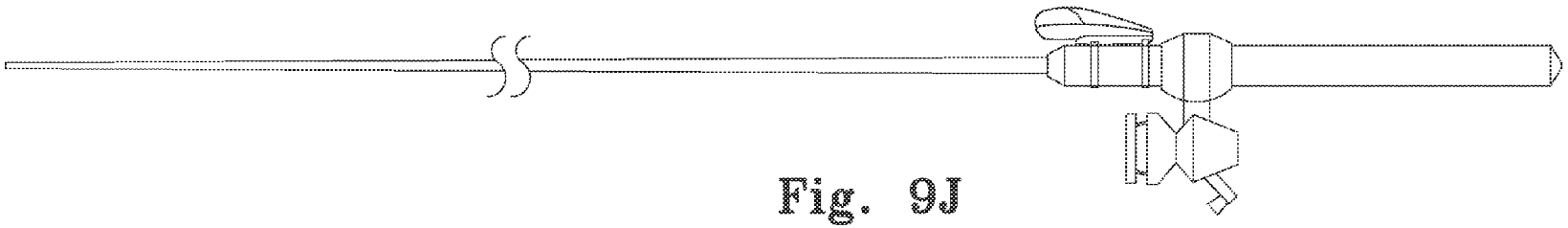
Figure 9K:
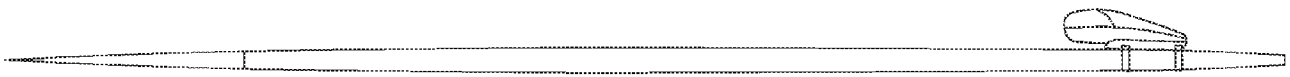
Figure 9L:
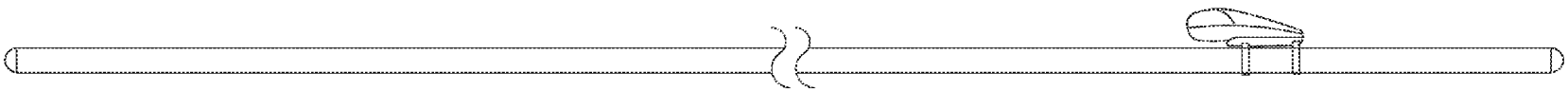
Figure 9M:
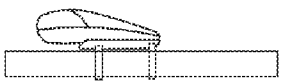
Figure 9P:
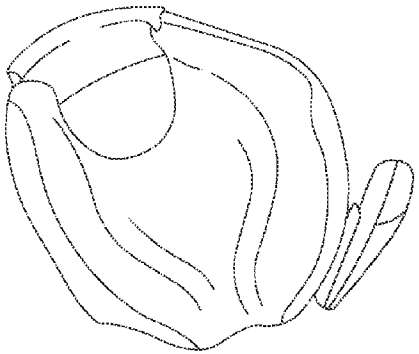
Figure 9Q:
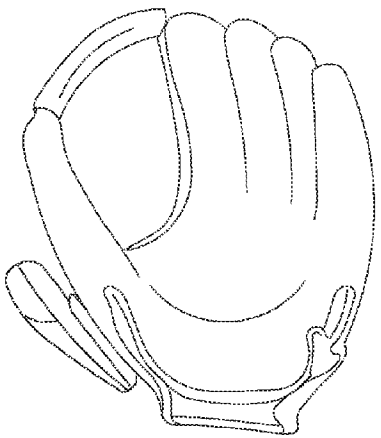
Figure 9O:
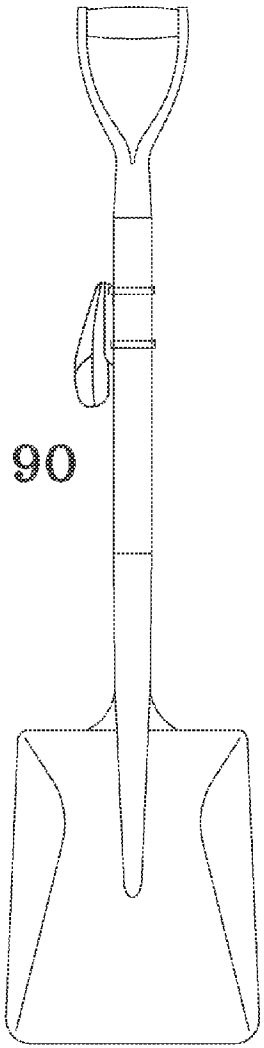
Figure 9N:
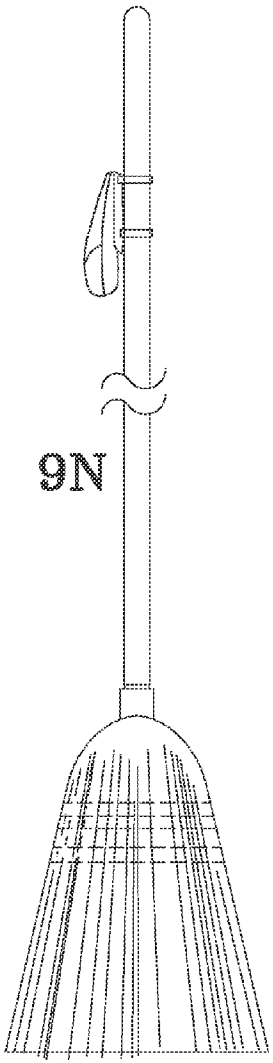

A variety of suitable pads 230 and cams 150 are shown in FIGS. 5-8. FIG. 5, for example, illustrates a kit of replacement parts for device 100 or 200. Pad 230*a* defines groove 235*a*, which is configured to receive the shaft of golf club when pad 230*a* is attached to lower shell 213, and one of golf cams 250*a* is attached to axle 355 to be driven by motor 340 (see FIG. 4). Likewise, pad 230*b* is configured for use with a baseball bat matching that configuration of groove 235*b*, in connection with use of cams 250*b*. Pad 230*c* is configured with groove 235*c*, which is adapted to receive the handle of a racquet (such as a tennis or racquetball racquet), and cams 250*c* are attachable to axle 355 to be driven by motor 340 to provide a suitable speed, magnitude or range of vibration. Pad 230*d* is configured for use with device 200 as a massager, where surface 235*d* directly contacts the skin of the user, and one of cams 250*d* provides suitable speed, magnitude or range of vibration. Other pad designs and cam configurations will occur to those skilled in the art. FIGS. 9A-9Q illustrate various embodiments of the present system, where the swingable item is a golf club, tennis racquet, racquetball racquet, squash racquet, baseball bat, cricket bat, hockey stick, lacrosse stick, jai alai basket, fishing rod, javelin, pole-vaulting pole, runner's baton, broom, shovel, mitt, and glove, respectively.

All publications, prior applications, and other documents cited herein are hereby incorporated by reference in their entirety as if each had been individually incorporated by reference and fully set forth. While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

While the inventions have been illustrated and described in detail in the drawings and foregoing description, the same is to be considered as illustrative and not restrictive in character, it being understood that the preferred embodiment has been shown and described and that changes and modifications that come within the spirit of the invention are desired to be protected.

What is claimed is:

1. An apparatus for training a person to perform a swinging motion, comprising:

a motor configured to drive an axle to spin on an axis;

a first body attached to the axle and having a mass that rotates and creates a vibration when the axle spins;

an attachment means that removably attaches the motor to a shaft of a swingable item; and a user-actuatable switch for activating the motor at least through substantially an entire swing of the swingable item, the entire swing comprising movement of the item from a first position to a different second position;

wherein the first body is removable from and reattachable to the axle; and further comprising a second body that is removably attachable to the axle and also comprises a mass that rotates and creates a vibration when the axle spins.

2. The apparatus of claim 1, wherein the swingable item is a golf club.

3. The apparatus of claim 1, wherein the swingable item is selected from the set of racquets consisting of:

a tennis racquet, a racquetball racquet, and a squash racquet.

4. The apparatus of claim 1, wherein the swingable item is selected from the set of items consisting of a baseball bat, a cricket bat, a hockey stick, a lacrosse stick, a jai alai basket, and a fishing rod.

5. The apparatus of claim 1, wherein the swingable item is selected from the set of items consisting of a javelin, a pole vaulting pole, and a runner's baton.

6. The apparatus of claim 1, wherein the swingable item is selected from the set of items consisting of a broom and a shovel.

7. The apparatus of claim 1, wherein the swingable item is selected from the set of items consisting of a mitt and a glove.

8. The apparatus of claim 1, wherein:

the motor and the body are substantially enclosed by an enclosure, and the enclosure is affixed to the attachment means.

9. The apparatus of claim 8, wherein the switch has a first and a second position; and further comprising a power source that energizes the motor when the switch is in the first position, de-energizes the motor when the switch is in the second position, and is situated within the enclosure.

10. The apparatus of claim 1, wherein the switch has a first and a second position; and further comprising a power source that energizes the motor when the switch is in the first position, de-energizes the motor when the switch is in the second position, and is attached to the motor.

11. The apparatus of claim 1, wherein the switch has a first and a second position; and further comprising a rechargeable power source that energizes the motor when the switch is in the first position, de-energizes the motor when the switch is in the second position, and is rechargeable.

12. The apparatus of claim 1, wherein the first body is removable from and reattachable to the axle; and further comprising a second body that is removably attachable to the axle and also comprises a mass that rotates and creates a vibration when the axle spins.

13. The apparatus of claim 1, further comprising a selector operable to change the speed of the motor.

14. An apparatus for training one to perform a swinging motion, comprising:

a vibration-inducing device;

a motor configured to drive an axle to spin on an axis;

a first body attached to the axle and having a mass that rotates and creates a vibration when the axle spins;

an attachment means that removably attaches the motor to a shaft of a swingable item; and a user-actuatable switch for activating the motor at least through substantially an entire swing of the swingable item, the entire swing comprising movement of the item from a first position to a different second position; and an attachment means that removably attaches the vibration-inducing device to a shaft of a swingable item, comprising a pad that is removably attached to the vibration-inducing device, and defines a recess configured to receive an elongated portion of the shaft;

wherein the first body is removable from and reattachable to the axle; and further comprising a second body that is removably attachable to the axle and also comprises a mass that rotates and creates a vibration when the axle spins.

15. The apparatus of claim 14, wherein:

the swingable item is a golf club having a shaft, and the elongated portion is the shaft.

16. The apparatus of claim 14, wherein:

the swingable item is a racquet having a handle, the item is selected from the set of racquets consisting of:

a tennis racquet, a racquetball racquet, and a squash racquet, and the elongated portion is selected from the group consisting of:

the handle of the racquet, and the neck of the racquet.

17. The apparatus of claim 14, wherein the swingable item is selected from the set of items consisting of a baseball bat, a cricket bat, a hockey stick, a lacrosse stick, a jai alai basket, and a fishing rod.

18. The apparatus of claim 14, wherein the swingable item is selected from the set of items consisting of a javelin, a pole vaulting pole, and a runner's baton.

19. The apparatus of claim 14, wherein the swingable item is selected from the set of items consisting of a broom and a shovel.

20. The apparatus of claim 14, wherein the swingable item is selected from the set of items consisting of a mitt and a glove.

21. The apparatus of claim 14, further comprising a selector operable to change the speed of the motor.

* * * * *